US009514856B2

(12) United States Patent
Shishido et al.

(10) Patent No.: US 9,514,856 B2
(45) Date of Patent: Dec. 6, 2016

(54) COPPER ALLOY

(75) Inventors: Hisao Shishido, Kobe (JP); Yasuhiro Aruga, Kobe (JP); Shinya Katsura, Shimonoseki (JP); Katsushi Matsumoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 296 days.

(21) Appl. No.: 14/127,724

(22) PCT Filed: Aug. 4, 2011

(86) PCT No.: PCT/JP2011/067900

§ 371 (c)(1),
(2), (4) Date: Dec. 19, 2013

(87) PCT Pub. No.: WO2013/018228

PCT Pub. Date: Feb. 7, 2013

(65) Prior Publication Data

US 2014/0193293 A1 Jul. 10, 2014

(51) Int. Cl.

| | |
|---|---|
| ***C22C 9/00*** | (2006.01) |
| ***C22C 9/02*** | (2006.01) |
| ***C22C 9/06*** | (2006.01) |
| ***H01B 1/02*** | (2006.01) |
| ***C22C 1/10*** | (2006.01) |
| ***C22C 9/04*** | (2006.01) |
| ***C22F 1/00*** | (2006.01) |
| ***C22F 1/08*** | (2006.01) |

(52) U.S. Cl.

CPC ..... *H01B 1/026* (2013.01); *C22C 1/10* (2013.01); *C22C 9/00* (2013.01); *C22C 9/02* (2013.01); *C22C 9/04* (2013.01); *C22C 9/06* (2013.01); *C22F 1/00* (2013.01); *C22F 1/08* (2013.01)

(58) Field of Classification Search

CPC ..... C22C 9/00; C22C 9/02; C22C 9/04; C22C 9/06

USPC ..... 148/432–435; 420/473, 476

See application file for complete search history.

(56) References Cited

U.S. PATENT DOCUMENTS

| | | | | |
|---|---|---|---|---|
| 2002/0119071 | A1 | 8/2002 | Usami et al. | |
| 2002/0127133 | A1 | 9/2002 | Usami et al. | |
| 2003/0165708 | A1 | 9/2003 | Usami et al. | |
| 2004/0045640 | A1 | 3/2004 | Usami et al. | |
| 2005/0208323 | A1 | 9/2005 | Usami et al. | |
| 2006/0201591 | A1 | 9/2006 | Kawahata et al. | |
| 2008/0190523 | A1 | 8/2008 | Gao et al. | |
| 2008/0190524 | A1 | 8/2008 | Gao et al. | |
| 2008/0277033 | A1 | 11/2008 | Kawahata et al. | |
| 2010/0000637 | A1 | 1/2010 | Hatano | |
| 2010/0047112 | A1* | 2/2010 | Fugono | C22C 9/06 420/470 |
| 2010/0193092 | A1 | 8/2010 | Matsuo et al. | |
| 2010/0316879 | A1 | 12/2010 | Mihara et al. | |

FOREIGN PATENT DOCUMENTS

| | | |
|---|---|---|
| JP | 2002-38228 A | 2/2002 |
| JP | 2002 180161 | 6/2002 |
| JP | 2006 152392 | 6/2006 |
| JP | 2006 219733 | 8/2006 |
| JP | 2006 249516 | 9/2006 |
| JP | 2008-013836 A | 1/2008 |
| JP | 2008 024999 | 2/2008 |
| JP | 2008 223136 | 9/2008 |
| JP | 4143662 B2 | 9/2008 |
| JP | 2008 266783 | 11/2008 |
| JP | 2011 17072 | 1/2011 |
| JP | 2011 52316 | 3/2011 |
| JP | 2011 162848 | 8/2011 |
| WO | 2009 099198 | 8/2009 |

OTHER PUBLICATIONS

International Search Report Issued Nov. 8, 2011 in PCT/JP11/067900 Filed Aug. 4, 2011.

Written Opinion of The International Searching Authority Issued Nov. 8, 2011 in PCT/JP11/067900 Filed Aug. 4, 2011.

* cited by examiner

*Primary Examiner* — Brian Walck

(74) *Attorney, Agent, or Firm* — Oblon, McClelland, Maier & Neustadt, L.L.P.

(57) ABSTRACT

Disclosed is a copper alloy containing 1.0% to 3.6% of Ni, 0.2% to 1.0% of Si, 0.05% to 3.0% of Sn, 0.05% to 3.0% of Zn, with the remainder including copper and inevitable impurities. The copper alloy has an average grain size of 25 μm or less and has a texture having an average area percentage of cube orientation of 20% to 60% and an average total area percentage of brass orientation, S orientation and copper orientation of 20% to 50%. The copper alloy has a KAM value of 0.8 to 3.0 and does not suffer from cracking even when subjected to U-bending. The copper alloy has excellent balance between strengths (particularly yield strength in a direction perpendicular to the rolling direction) and bending workability.

8 Claims, No Drawings

COPPER ALLOY

TECHNICAL FIELD

The present invention relates to copper alloys having low strength anisotropy, and satisfactory bending workability. Specifically, the present invention relates to high-strength copper alloys that are used for electric and electronic components and are advantageously usable typically in automobile connectors.

BACKGROUND ART

With recent requirements for reduction in size and weight of electronic appliances, electric and electronic components are more and more reduced in size and weight. The electric and electronic components are exemplified by connectors, terminals, switches, relays, and lead frames.

For the reduction in size and weight of electric and electronic components, copper alloy materials for use in the components are designed to have more and more reduced thickness and width. Especially for integrated circuit (IC) use, copper alloy sheets having small thickness of from 0.1 to 0.15 mm have also been employed. As a result, copper alloy materials for use in such electric and electronic components should have much higher tensile strengths. For example, high-strength copper alloy sheets having a yield strength of 650 MPa or more are required typically in automobile connectors.

The copper alloy sheets for use in the components such as connectors, terminals, switches, relays, and lead frames should have not only high strengths and high electrical conductivity as mentioned above, but also satisfactory bending workability in severe bending such as U-bending (180-degree tight bending) in more and more cases.

In addition, the reduction in thickness and width of electric and electronic components causes reduction in cross-sectional area of electroconductive portions of copper alloy materials. The cross-sectional area reduction results in electroconductivity reduction. To supplement the electroconductivity reduction, the copper alloy materials themselves should have a satisfactory electrical conductivity of 30% IACS (International Annealed Copper Standard) or more.

For these reasons, a Corson alloy (Cu—Ni—Si copper alloy) has been used for electric and electronic components, because this alloy excels in the various properties as mentioned above and is inexpensive. In the Corson alloy, the solid solubility limit of a nickel silicate compound ($Ni_2Si$) with respect to copper significantly varies with temperature. This alloy is a kind of precipitation-hardening alloys that are hardened by quenching/tempering. The Corson alloy has heat resistance and high-temperature strength at satisfactory levels and has been widely used typically in electroconducting springs and electric wires or cables for high tensile strength use.

However, the Corson alloy features significant strength anisotropy between a longitudinal direction (LD) (a direction parallel with the rolling direction) and a transverse direction (TD) (a direction perpendicular to the rolling direction), namely, has a strength in the transverse direction relatively lower than that in the longitudinal direction. The Corson alloy also features a large difference between its tensile strength (TS) and 0.2% yield strength (YP). For these reasons, the Corson alloy, when used in terminals/connectors, disadvantageously suffers typically from a low yield strength and an insufficient contact pressure strength in the transverse direction.

Independently, the Corson alloy, when designed to have a higher strength so as to have a higher contact pressure strength, disadvantageously suffers from cracking upon bending. Under such circumstances, demands have been made to develop a novel Corson alloy that has low strength anisotropy and excellent bending workability, which two properties are considered to be mutually contradictory.

To improve the bending workability of the Corson alloy, there have been proposed various techniques. Typically, Patent Literature (PTL) 1 proposes a technique of allowing a Corson alloy to contain Mg in addition to Ni and Si and controlling the S (sulfur) content of the alloy so as to improve strength, electroconductivity, bending workability, stress relaxation resistance, and coated-layer adhesiveness to suitable levels. PTL 2 proposes a technique of subjecting a Corson alloy to a solution heat treatment and then to aging without cold rolling so as to control inclusions to have sizes of 2 μm or less and to control the total amount of inclusions each having a size of from 0.1 μm to 2 μm to 0.5% or less of the total volume.

In addition, techniques of controlling grain textures are proposed so as to allow a Corson alloy to have better bending workability. Typically, PTL 3 proposes a copper alloy sheet made from a Corson alloy containing Ni in a content of from 2.0 to 6.0% in mass percent and Si in a mass ratio of Ni to Si of from 4 to 5. This Corson alloy is controlled to have an average grain size of 10 μm or less and to have a texture including cube orientation {001}<100> in a percentage of 50% or more as measured by SEM-EBSP analysis and has no lamellar boundary observable by microstructure observation with an optical microscope at 300-fold magnification.

Above-mentioned PTL 3 discloses a sheet of a Corson alloy, in which the Corson alloy has an electrical conductivity of from about 20% to about 45% IACS, has a high strength in terms of tensile strength of from about 700 to about 1050 MPa, and exhibits satisfactory bending workability. This copper alloy sheet is obtained in a manner as follows. When a copper alloy rolled sheet of a Cu—Ni—Si copper alloy (Corson alloy) is subjected to finish cold rolling, the sheet is cold-rolled to a working ratio of 95% or more before a final solution treatment, subjected to the final treatment, further cold-rolled to a working ratio of 20% or less after the final solution treatment, and subjected to aging so as to control the Corson alloy to have the microstructure as mentioned above.

PTL 4 discloses a technique of controlling a Cu—Ni—Si copper alloy to have such diffraction intensities of {420} plane and {220} plane as to satisfy conditions expressed as follows: $I\{420\}/I0\{420\}>1.0$, $I\{220\}/I0\{220\}\leq 3.0$ and thereby allowing the alloy to have better bending workability.

Independently, PTL 5 proposes a technique of increasing the amount of solutes after solution heat treatment so as to eliminate or mitigate strength anisotropy.

PTL 6 proposes a technique of controlling grain shape so as to eliminate or mitigate strength anisotropy. This technique reduces strength anisotropy by performing rolling to a final rolling reduction of 3.0% or less and thereby allowing grains to have reduced length both in the longitudinal direction and in the transverse direction.

PTL 7 proposes a technique of controlling the diffraction intensity of {220} crystal plane and the diffraction intensity of {200} crystal plane respectively so as to provide low strength anisotropy and better bending workability.

CITATION LIST

Patent Literature

PTL 1: Japanese Unexamined Patent Application Publication (JP-A) No. 2002-180161
PTL 2: JP-A No. 2006-249516
PTL 3: JP-A No. 2006-152392
PTL 4: JP-A No. 2008-223136
PTL 5: JP-A No. 2006-219733
PTL 6: JP-A No. 2008-24999
PTL 7: JP-A No. 2008-223136

SUMMARY OF INVENTION

Technical Problem

The Corson alloys described in PTL 1 to 4 are to be used in down-sized and weight-reduced electric and electronic components so as to exhibit satisfactory bending workability even upon bending under severe conditions, such as 90-degree bending after notching.

The Corson alloys described in PTL 5 and 6 are to be used in down-sized and weight-reduced electric and electronic components and have low strength anisotropy and higher contact pressure strengths in the transverse direction.

However, even these improved Corson alloys suffer typically from cracking when they are subjected to bending under severer conditions than ever, such as U-bending (180-degree tight bending), at a strength level in terms of 0.2% yield strength in the transverse direction of 650 MPa or more. To solve these disadvantages, demands have been made to further improve the bending workability of Corson alloys.

As is described in PTL 5, rolling is preferably performed to a low final rolling reduction so as to control the texture and to provide better bending workability. On the other hand, rolling is preferably performed to a high final rolling reduction so as to control the texture to eliminate or mitigate the strength anisotropy, as described in PTL 7. A Corson alloy sheet, when undergone rolling to a high final rolling reduction so as to have a high dislocation density, generally has a smaller difference between the tensile strength and the 0.2% yield strength, and this well contributes to a higher contact pressure strength. Thus, the mitigation of strength anisotropy for higher yield strength in the transverse direction is very hardly compatible with the improvement in bending workability according to the customary techniques.

The technique described in PTL 7 mitigates the strength anisotropy and improves the bending workability to some extent, but fails to be a satisfactory technique to give a copper alloy having both low strength anisotropy and excellent bending workability, because the technique merely controls the balance between strengths anisotropy and bending workability to a suitable level by controlling the final rolling reduction. Specifically, the technique described in PTL 7 fails to provide sufficiently better balance between strengths anisotropy and bending workability. Elimination of strength anisotropy and further improvement in bending workability now remains an issue to be addressed.

Accordingly, the present invention has been made to solve the problems of the customary techniques, and an object thereof is to provide a copper alloy as follows. This copper alloy enables mutually contradictory controls of a copper alloy, i.e., texture control for better bending workability and dislocation density control for lower strength anisotropy, in combination. The copper alloy does not suffer from cracking even subjected to U-bending. In addition, the copper alloy has superior balance between the strengths (particularly yield strength in the transverse direction) and the bending workability.

Solution to Problem

Specifically, the present invention provides a copper alloy having low strength anisotropy and excellent bending workability. This copper alloy contains: Ni in a content of from 1.0% to 3.6%; Si in a content of from 0.2% to 1.0%; Sn in a content of from 0.05% to 3.0%; and Zn in a content of from 0.05% to 3.0%, in mass percent, in which the copper alloy further contains copper and inevitable impurities; the copper alloy has an average grain size of 25 μm or less; the copper alloy includes a texture having an average area percentage of cube orientation {011}<100> of from 20% to 60% and having an average total area percentage of specific three orientations of from 20% to 50% as measured by scanning electron microscope-electron back-scattering pattern analysis (SEM-EBSP), the three orientations being brass orientation {011}<211>, S orientation {123}<634>, and copper orientation {112}<111>; and the copper alloy has a kernel average misorientation (KAM) value of from 1.00 to 3.00 (claim 1).

The copper alloy having low strength anisotropy and excellent bending workability (claim 1) may further contains at least one element selected from the group consisting of Fe, Mn, Mg, Co, Ti, Cr, and Zr in a total content of from 0.01% to 3.0% in mass percent (claim 2).

Advantageous Effects of Invention

The present inventors reviewed processes to manufacture Corson alloys and made a wide variety of investigations on conditions so as to give a Corson alloy that has low strength anisotropy and a high yield strength in the transverse direction and exhibits such better bending workability as to be resistant to cracking even under severer conditions as in the U-bending.

To eliminate strength anisotropy and to increase the yield strength in the transverse direction, rolling after solution heat treatment should be performed to a higher rolling reduction so as to increase the dislocation density, as is described in PTL 7. On the other hand, a Corson alloy, if manufactured through rolling to a higher rolling reduction after solution heat treatment, has inferior bending workability due to a lower area percentage of {001}<100> cube orientation acting as a recrystallization texture, as is described in PTL 5 and PTL 7. Accordingly, to increase the yield strength in the transverse direction through the elimination of strength anisotropy and to improve bending workability, a Corson alloy should be manufactured so as to have a higher dislocation density while minimizing the rolling reduction of the rolling after solution heat treatment. The present inventors have found that detailed investigations on the kernel average misorientation (KAM), which has a correlation to the dislocation density, through scanning electron microscope-electron back scattering diffraction (SEM-EBSD) analysis enables the control of the process after solution heat treatment and provides a higher dislocation density of the resulting sheet even at a relatively low rolling reduction.

The present inventors have made detailed investigations on the texture before and after final cold rolling through SEM-EBSD analysis and have also found that large amounts of grains having crystal orientation as before rolling remain even after rolling. In addition, the present inventors have found that, for the accumulation of cube-oriented grains at a higher percentage (degree) before final rolling, it is important to perform rolling to a higher rolling reduction before the solution heat treatment and to perform the solution heat treatment at a low rate of temperature rise.

Bad on these findings, the present inventors have found that accumulation of cube-oriented grains at a higher degree of accumulation before final rolling enables accumulation of cube-oriented grains at a higher degree of accumulation in the copper alloy sheet after the final rolling even when the final rolling is performed to a high rolling reduction. This enables manufacturing of a targeted copper alloy having low anisotropy and excellent bending workability.

The technique disclosed in PTL 7 reduces strength anisotropy and improves bendability by controlling the final rolling reduction and thereby controlling the X-ray diffraction intensity I{220} of {220} plane as a rolling texture within the range of from 3.0 to 6.0 ($3.0 \leq I\{220\}/I0\{220\} \leq 6.0$) and the X-ray diffraction intensity I{200} of {200} plane as a recrystallization texture within the range of from 1.5 to 2.5 ($1.51 \leq \{200\}/I0\{200\} \leq 2.5$). According to this technique, a higher yield strength in the transverse direction is provided probably because rolling after solution heat treatment is performed to a relatively high rolling reduction of from 35% to 50%, and the resulting copper alloy has a relatively high KAM value and exhibits higher anisotropy.

However, the texture control according to the present invention controls not only crystal planes, but also crystal plane orientations. Specifically, the present invention performs a more detailed control, in which, of {200} planes as detected through X-ray diffraction, the area percentage of cube orientation defined as {001}<100> is increased, and, of {220} planes as detected through X-ray diffraction, the area percentages of brass orientation defined by {111}<211>, S orientation defined as {123}<634>, and copper orientation defined as {112}<111> are decreased respectively. Accordingly, copper alloy sheets, if manufactured under the conditions described in PTL 7 as in Comparative Examples 25 and 26 in after-mentioned Experimental Examples, particularly have a lower cube orientation area percentage and exhibit lower bendability than those of examples according to the present invention.

In that regard, the technique described in PTL 5 controls the copper alloy to contain cube orientation {001}<100> in a large percentage of 50% or more as measured by SEM-EBSP analysis. To increase the percentage of the cube orientation, the technique permits the presence, as joint orientations, of other orientations than cube orientation, such as S orientation {123}<634> and B orientation {011}<211>, which orientations inevitably occur in a Corson alloy sheet manufactured by a regular method and adversely affect the bending workability. Specifically, in Examples given in Table 2 of this literature, the total percentage of S orientation and B orientation is controlled (permitted) to a range of from about 16% to about 33%.

Thus, the technique described in PTL 5 enables control of the Corson alloy texture, but employs a manufacturing method in which cold rolling is performed to a relatively low rolling reduction of 20% after solution heat treatment. The resulting Corson alloy therefore much excels in tensile strength in the longitudinal direction and bendability, but has a small KAM value, suffers from high strength anisotropy, and has a low strength in the transverse direction as in Comparative Example 33 described in after-mentioned Experimental Examples.

In contrast, the present invention enables control of the texture and the KAM value by controlling the rolling reduction of rolling before solution treatment, the rate of temperature rise in the solution heat treatment, and the final rolling reduction. Accordingly, the present invention enables manufacturing of a Corson alloy having low strength anisotropy and a high yield strength particularly in the transverse direction and having good balance in bending workability, and helps the Corson alloy to have further better properties.

The present invention thereby provides a Corson alloy having such satisfactory balance between strengths and bending workability as not to suffer from cracking even under severer working conditions as in U-bending even at a high strength level in terms of 0.2% yield strength in the transverse direction of 650 MPa or more. This is supported by Experimental Examples. Specifically, the present invention can provides a copper alloy having low strength anisotropy and excellent bending workability.

DESCRIPTION OF EMBODIMENTS

Some embodiments of the present invention will be illustrated in detail by required condition basis below. Initially, conditions in microstructure of the copper alloy according to the present invention will be sequentially illustrated. In the description as follows, the average grain size and the average area percentage of a texture are also simply referred to as "grain size" and "area percentage" with omission of "average."

Average Grain Size

A copper alloy is known to have better balance between strengths and bending workability with a decreasing average grain size. The present inventors have found that control of the texture can provide satisfactory bending workability even at a relatively large grain size. The average grain size is preferably 25 μm or less, and more preferably 15 μm or less. The average grain size can be reduced to about 1 μm and is preferably minimized.

Texture

The present inventors have focused attention on the fact that cracking upon bending proceeds or propagates along a deformation zone and a shear zone and have found that formation behaviors of the deformation zone and shear zone upon U-bending vary from one texture (oriented grain) to another.

Cube Orientation

The cube orientation {001}<100> allows larger amounts of slip systems to act. Accumulation of the cube orientation (cube-oriented grains) to an area percentage of 20% or more impedes local deformation progress and contributes to better U-bending workability. The cube-oriented grains, if accumulated at an excessively low degree, may fail to suppress the local deformation progress and may cause the copper alloy to have inferior U-bending workability. To prevent this, the average area percentage of cube orientation {001}<100> is herein controlled to 20% or more, and preferably 30% or more.

In contrast, the cube-oriented grains, if accumulated at an excessively high degree, may cause the copper alloy to have an insufficient strength due to a low average total area percentage of the three orientations, i.e., brass orientation {011}<211>, S orientation {123}<634>, and copper orientation {112}<111>, as mentioned later. To prevent this, the cube orientation average area percentage is controlled to 60% or less. This parameter is controlled within the range of from 20% to 60%, and preferably from 30% to 50%, so as to provide low strength anisotropy and better bending workability.

Three Orientations i.e., Brass Orientation, S Orientation, and Copper Orientation:

When the texture control is performed in combination with the microstructure control for grain size refinement as in the present invention, not only the cube orientation average area percentage should be controlled, but also the average total area percentage of the three orientations, i.e., brass orientation {011}<211>, S orientation {123}<634>, and copper orientation {112}<111> should be controlled to better balance to obtain better U-bending workability.

In the three orientations, i.e., brass orientation, S orientation, and copper orientation, slip systems capable of acting are limited. For this reason, these orientations, if accumulated at an excessively high degree, may cause local deformation and cause the copper alloy to have inferior U-bending workability. To prevent this and to improve the bending workability, the total area percentage of the three orientations, i.e., brass orientation, S orientation, and copper orientation is controlled to 50% or less, and more preferably 40% or less, on average.

On the other hand, the three types of oriented grains are formed during rolling and contribute to higher strengths when accumulated in certain amounts. These oriented grains, if present in an excessively low total sum of respective area percentages (total area percentage), may cause the copper alloy to have insufficient work hardening through rolling and to have insufficient strengths. To prevent this and to improve the strengths, the average total area percentage of the three orientations is controlled to 20% or more, and more preferably 30% or more in terms of its lower limit.

To provide both low strength anisotropy and satisfactory U-bending workability, therefore, the average total area percentage of the three orientations, i.e., brass orientation {011}<211>, S orientation {123}<634>, and copper orientation {112}<111>, is controlled to the range of from 20% to 50%, and more preferably to the range of from greater than 40% to 50%.

Methods for Average Grain Size, Metallic Texture, and KAM Value Measurements

The texture of a surface layer in the sheet thickness direction of the product copper alloy is herein measured so as to measure the average grain size. The measurement is performed by a crystal orientation analysis method using a field emission scanning electron microscope (FESEM) equipped with an electron back scattering (scattered) pattern (EBSP) analysis system.

In the EBSP analysis, a sample is placed in the lens barrel (body tube) of the FESEM, and a beam of electrons is applied to the sample to project an electron back scattering pattern (EBSP) onto a screen. An image of the projected pattern is taken with a highly sensitive camera and captured as an image into a computer. The computer analyzes the image to determine crystal orientations by comparison with simulated patterns using known crystal systems. The calculated crystal orientations are recorded as three-dimensional Eulerian angles together with other data such as position coordinates (x, y). This process is automatically performed on entire measurement points gives crystal orientation data at several tens of thousands to hundreds of thousands of points upon the completion of the measurement.

In regular copper alloy sheets, there are formed textures including many orientation components typically called cube orientation, Goss orientation, brass orientation, copper orientation, and S orientation, and crystal planes corresponding to these orientation components are present. These facts can be found typically in "Texture" (Maruzen Co., Ltd.) edited and written by S. Nagashima; and in Journal of Japan Institute of Light Metals, "Light Metals," Vol. 43 (1993), pp. 285-293. These textures, even when belonging to the same crystal system, are formed in different manners according to the working and heat treatment procedures. Textures of a sheet obtained through rolling are indicated by a rolling plane and a rolling direction, in which the rolling plane is expressed as {ABC}, and the rolling direction is expressed as <DEF>, where each of A, B, C, D, E, and F represents an integer. Based on these expressions, the respective orientations are expressed as follows:

Cube orientation {001}<100>
Goss orientation {011}<100>
Rotated-Goss orientation {011}<011>
Brass orientation {011}<211>
Copper orientation {112}<111>
(or D orientation {4411}<11118>
S orientation {123}<634>
B/G orientation {011}<511>
B/S orientation {168}<211>
P orientation {011}<111>

In the present invention, a crystal plane (orientation component) with an orientation deviation within ±15 degrees from one of these crystal planes is regarded as belonging to the one crystal plane (orientation component). As used herein the term "grain boundary" is defined as a grain boundary between adjacent grains with a difference in orientations of 5 degrees or more.

Based on this, the average grain size herein is calculated as $(\Sigma x)/n$, in which n represents the number of grains as measured by applying a beam of electrons to the sample in a measurement area of 300 by 300 μm at a pitch of 0.5 μm and counting grains by the crystal orientation analysis method; and x represents the measured grain size of each grain.

The area percentage (average) of each orientation with respect to the measurement area is herein determined by applying a beam of electrons to the sample in a measurement area of 300 by 300 μm at a pitch of 0.5 μm; identifying each crystal orientation by the crystal orientation analysis method; and measuring an area of each identified crystal orientation.

The crystal orientations can each have a distribution in the sheet thickness direction. For this reason, the area percentage of each orientation is preferably determined by measuring area percentages at arbitrary several points in the sheet thickness direction and averaging the measured area percentages.

Independently, the kerner average misorientation (KAM) value is measured by measuring an orientation difference in a grain through EBSP analysis. The KAM value is defined herein as $(\Sigma y)/n$, in which n represents the number of grains; and y represents the difference between measured respective grain orientations. The KAM value has been reported to have a correlation to the dislocation density, and this can be found typically in "Material" (Journal of the Society of Materials Science, Japan), Vol. 58, No. 7, pp. 568-574, July 2009.

Copper Alloy Chemical Composition

Next, the chemical composition of the copper alloy according to the present invention will be illustrated. The chemical composition of the copper alloy according to the present invention is a precondition for obtaining a Corson alloy that has satisfactory balance between strengths and bending workability so as not to suffer from cracking upon U-bending even at a high strength level in terms of 0.2% yield strength in the transverse direction of 650 MPa or more. Based on this, the copper alloy according to the present invention is specified to have a chemical composition containing Ni in a content of from 1.0% to 3.6%; Si in a content of from 0.2% to 1.0%; Sn in a content of from 0.05% to 3.0%; and Zn in a content of from 0.05% to 3.0% and, where necessary, further containing at least one element selected from the group consisting of Fe, Mn, Mg, Co, Ti, Cr, and Zr in a total content of from 0.01% to 3.0%, in mass percent, in which the copper alloy further contains copper and inevitable impurities. All percentages as contents described herein are in mass percent.

Why the contents of respective elements are specified herein will be sequentially illustrated below.

Ni: 1.0% to 3.6%

Nickel (Ni) forms a compound with silicon (Si) as precipitates and helps the copper alloy to have strengths and electrical conductivity at certain levels. Ni, if contained in an excessively low content of less than 1.0%, may fail to form the precipitates in a sufficient amount, fail to help the copper alloy to have desired strengths, and cause the copper alloy microstructure to include coarsened grains. In contrast, Ni, if contained in an excessively high content of greater than 3.6%, may cause the copper alloy to have a low electrical conductivity and, in addition, to have inferior bending workability due to coarse precipitates in an excessively large number. To prevent these, the Ni content is controlled within the range of from 1.0% to 3.6%.

Si: 0.20% to 1.0%

Silicon (Si) forms the compound with Ni as precipitates and helps the copper alloy to have higher strengths and a higher electrical conductivity. Si, if contained in an excessively low content of less than 0.20%, may fail to form the precipitates in a sufficient amount, fail to help the copper alloy to have desired strengths, and cause grains to be coarsened. In contrast, Si, if contained in an excessively high content of greater than 1.0%, may cause the copper alloy to have inferior bending workability due to coarse precipitates in an excessively large number. To prevent these, the Si content is controlled within the range of from 0.20% to 1.0%.

Zn: 0.05% to 3.0%

Zinc (Zn) element effectively improves the thermal peeling resistance of tin plating or solder for use in jointing of electronic components and protects the plating or solder from thermal peeling. To exhibit such effects well, Zn should be contained in a content of 0.05% or more. However, Zn, if contained in excess, may contrarily adversely affect the wetting extendability of molten tin or solder and cause the copper alloy to have a significantly low electrical conductivity. In addition, Zn, if contained in excess, may cause the copper alloy to contain cube orientation in a smaller area percentage and to contain the three orientations, i.e., brass orientation, S orientation, and copper orientation in a larger total area percentage; and this may cause imbalance in area percentage between the orientations of two categories. To prevent this, the Zn content is determined within the range of from 0.05% to 3.0%, and preferably within the range of from 0.05% to 1.5% in consideration of improvement in thermal peeling resistance and reduction in electrical conductivity.

Sn: 0.05% to 3.0%

Tin (Sn) dissolves as a solute in the copper alloy and helps the copper alloy to have higher strengths. To exhibit the effect well, Sn should be contained in a content of 0.05% or more. However, Sn, if contained in excess, may exhibit a saturated effect and cause the copper alloy to have a significantly low electrical conductivity. In addition, such excessive Sn may cause the copper alloy to contain cube orientation in a low area percentage, but to contain the three orientations, i.e., brass orientation, S orientation, and copper orientation, in a larger total area percentage. To avoid these, the Sn content is determined within the range of from 0.05% to 3.0%, and preferably within the range of from 0.1% to 1.0% in consideration of improvement in strength and reduction in electrical conductivity.

At Least One Element Selected from the Group Consisting of Fe, Mn, Mg, Co, Ti, Cr, and Zr in Total Content of from 0.01% to 3.0%

These elements are effective for grain refinement. In addition, these elements, when forming compounds with Si, contribute to higher strengths and a higher electrical conductivity. To exhibit these effects, at least one element selected from the group consisting of Fe, Mn, Mg, Co, Ti, Cr, and Zr is preferably contained in a total content of 0.01% or more. However, these elements, if contained in a total content (total amount) of more than 3.0%, may cause the compounds to be coarsened and cause the copper alloy to have inferior bending workability. To prevent this, these elements, when contained selectively, may be contained in a total content (total amount) of from 0.01% to 3.0%.

Manufacturing Conditions

Next, preferred manufacturing conditions to allow the copper alloy to have microstructures as specified in the present invention will be illustrated below. The copper alloy according to the present invention is basically a copper alloy sheet obtained through rolling, but also includes strips or ribbons prepared by slitting the rolled sheet in the transverse direction (width direction), as well as coils obtained from such sheet or strip.

According to the present invention, a final (product) sheet is obtained through steps including casting of a copper alloy molten metal having a chemical composition controlled within the above-specified range to give ingots; and, of the ingots, facing, soaking, hot rolling, cold rolling, solution treatment (recrystallization annealing), age hardening, cold rolling, and low-temperature annealing.

Hot Rolling

The hot rolling is preferably performed to an end temperature of from 550° C. to 850° C. Hot rolling, if performed in a temperature range whose end temperature is lower than 550° C., may cause the copper alloy to have a nonuniform microstructure due to imperfect recrystallization and to thereby have inferior bending workability. In contrast, hot rolling, if performed to an end temperature of higher than 850° C., may cause grains to be coarsened and cause the copper alloy to have inferior bending workability. After the hot rolling, the work is preferably cooled with water.

Cold Rolling

The resulting hot-rolled sheet is subjected to cold rolling called "rough rolling or primary rolling." The copper alloy sheet after the rough rolling is subjected to solution treatment and finish cold rolling, further to aging, and yields a copper alloy sheet having a product thickness.

Finish Cold Rolling

In general, the finish cold rolling is performed in two stages, i.e., the first stage and second stage, before and after the final solution treatment. The cold rolling before the solution heat treatment is herein performed to a high cold rolling reduction of preferably 90% or more, and more preferably 93% or more. The cold rolling, if performed to a cold rolling reduction of less than 90%, may fail to give a desired texture due to an excessively small area percentage of final cube orientation. Rolling/annealing steps may be repeated according to necessity after the hot rolling, as long as the rolling reduction immediately before the solution treatment be 90% or more.

Final Solution Treatment

The final solution treatment is an important step for obtaining the desired grain size and texture. After detailed investigations on microstructures in respective temperature ranges during the final solution treatment (solution heat treatment), the present inventors have found that cube-oriented grains more preferentially grow and the cube orientation is contained in a larger area percentage with a decreasing rate of temperature rise and with an increasing grain size. To obtain the desired microstructure as specified in the present invention, therefore, the temperature and the rate of temperature rise of the solution heat treatment should be controlled.

Specifically, the work is preferably heated to a temperature of from 800° C. to 900° C. at a rate of temperature rise of 0.1° C./s or less in the final solution treatment.

The solution treatment, if performed at a temperature of 800° C. or lower or at a rate of temperature rise of greater than 0.1° C./s, may impede sufficient preferential growth of the cube-oriented grains, cause the cube orientation to present in a small area percentage, and cause the copper alloy to have inferior bending workability. The solution heat treatment, if performed at an excessively low temperature, may cause an excessively small solute amount after the solution heat treatment, and this may cause the quantity of strengthening by aging to be small and cause the copper alloy to have an excessively low final strengths. In contrast, the solution treatment, if performed at a temperature of 900° C. or higher, may cause grains to have larger sizes (to be coarsen) and cause the copper alloy to have inferior bending workability.

Treatments after Solution Treatment

Aging is performed subsequent to the solution heat treatment. Regular manufacturing methods of Cu—Ni—Si alloys employ a process of sequentially performing solution treatment, cold rolling, and aging in this order. When aging is performed after cold rolling in the above manner, precipitation of fine second phase particles having a size of 20 nm or less and recovery occur during the aging process. Accordingly, aging, if performed at a high temperature for a long time so as to increase the amount of precipitated fine second phase particles having a size of 20 nm or less, may excessively reduce the dislocation density and cause the copper alloy to have higher anisotropy. In contrast, aging, if performed at a low temperature for a short time so as to increase the dislocation density, may cause the fine second phase particles having a size of 20 nm or less to precipitate in a smaller amount and cause the copper alloy to have excessively low strengths. To prevent these, aging and cold rolling are preferably sequentially performed in this order after the solution heat treatment. When subjected to these steps in this order, the resulting copper alloy can have both high strengths and low anisotropy. This is because the aging step controls the precipitation of fine second phase particles having a size of 20 nm or less, and separately from this, the cold rolling step controls the dislocation density.

In addition, the present inventors made detailed investigations on the KAM value through SEM-EBSP analysis, which KAM value has a correlation to the dislocation density. As a result, the present inventors have found that a manufacturing process of sequentially performing solution heat treatment step, aging step, and rolling step in this order can provide, even at an identical rolling reduction, a larger KAM value than that in the customary manufacturing process of sequentially performing solution heat treatment, cold rolling, and aging in this order; and that according to this technique, a relatively high dislocation density can remain even at a relatively low rolling reduction.

From these viewpoints, the aging is preferably performed at a temperature of from 400° C. to 550° C. The aging, if performed at a temperature of lower than 400° C., may cause the fine second phase particles having a size of 20 nm or less to be present in an excessively small amount, and this may cause the copper alloy to have low strengths. The aging, if performed at a temperature of higher than 550° C., may cause the fine second phase particles having a size of 20 nm or less to be relatively coarsen, and this may also cause the copper alloy to have low strengths.

The final cold rolling is performed to a rolling reduction of preferably from 25% to 60% and more preferably from 30% to 50%. The final cold rolling, if performed to a rolling reduction of less than 25%, may cause the copper alloy to have an excessively low KAM value of 0.8 or less and to have high strength anisotropy. In contrast, the final cold rolling, if performed to a rolling reduction of greater than 60%, may cause the copper alloy to have an excessively high KAM value of 3.0 or more and to contain the cube orientation in an excessively small area percentage, and the resulting copper alloy may suffer from cracking upon bending.

After the final cold rolling, low-temperature annealing may be performed so as to allow the copper alloy sheet to have a smaller residual stress, a higher spring bending elastic limit, and better stress relaxation resistance. The heating in this process is preferably performed at a temperature of from 250° C. to 600° C. This relieves the residual stress in the copper alloy sheet and allows the sheet to have better bending workability and a higher elongation at break with little strength reduction. This also allows the sheet to have a higher electrical conductivity. The heating, if performed at an excessively high temperature, may cause the copper alloy to have a low KAM value and to be softened (dehardened). In contrast, the heating, if performed at an excessively high temperature, may not provide sufficient improvements in the properties.

EXAMPLES

The present invention will be illustrated in further detail with reference to several examples (experimental examples) below. It should be noted, however, that the following examples are never intended to limit the scope of the present invention; and that various modifications, changes, and alternations not deviating from the spirit and scope of the present invention are possible and all fall within the technical scope of the present invention.

Experimental examples according to the present invention will be illustrated below. Copper alloy thin sheets were manufactured from Cu—Ni—Si—Zn—Sn copper alloys having chemical compositions given in Tables 1 and 2 under different conditions given in Tables 1 and 2. On the copper alloy sheets, the sheet microstructures such as the average grain size, texture, and KAM value; and sheet properties such as the strength, electrical conductivity, and bendability were examined and evaluated. The results are indicated in Tables 3 and 4.

Specifically, the copper alloy sheets were manufactured in the following manner. Initially copper alloys were melted as being covered with charcoal in a kryptol furnace in the atmosphere, cast into a cast-iron book mold, and yielded 50-mm thick ingots having the chemical compositions given in Tables 1 and 2. The ingots were subjected to surface facing, hot rolling at a temperature of 950° C. to a thickness of from 6.00 to 1.25 mm, and rapidly cooled down from a temperature of 750° C. or higher in water. Next, after removing oxidized scale, the works were subjected to cold rolling and yielded sheets having a thickness of from 0.20 to 0.33 mm.

Next, the works were subjected to solution treatment under different conditions given in Tables 1 and 2 using a batch furnace at a rate of temperature rise of from 0.03° C. to 0.1° C., or a salt bath furnace at a rate of temperature rise of from 40 to 80° C./s, or an electric heater, and then cooled with water.

These samples after the solution treatment (heat treatment) were subjected to annealing in a batch furnace for 2 hours and to finish cold rolling as second cold rolling, and yielded 0.15-mm thick cold-rolled sheets. The cold-rolled sheets were subjected to low-temperature annealing in a salt bath furnace at 480° C. for 30 seconds and yielded final copper alloy sheets.

Microstructure

Average Grain Size, Average Area Percentages of Respective Orientations, and KAM Value:

A microstructure observation specimen was sampled from each of the above-prepared copper alloy thin sheet samples and examined on average grain size and average area percentages of respective orientations according to the above procedure by the crystal orientation analysis method using a field emission scanning electron microscope equipped with an electron back scattering pattern analysis system. Specifically, the rolling plane of each of the product copper alloys was mechanically polished, further buffed, electropolished, and yielded a specimen having a treated surface. Next, the crystal orientation and grain size of the specimen were measured with the FESEM (JEOL JSM 5410) supplied by JEOL Ltd. The measurement was performed in a measurement area of 300 μm long by 300 μm wide at a step interval of 0.5 μm.

An EBSP analysis system (OIM) supplied by TSL Solutions was used as the EBSP measurement/analysis system. The average grain size (μm) was defined as $(\Sigma x)/n$, in which n represents the number of grains; and x represents the measured grain size of each grain. The area percentage of each orientation was determined by measuring the area of each orientation by EBSP analysis, and calculating the area percentage of each orientation based on the entire measurement area. As a reference for comparison with the customary techniques, Table 2 indicates the percentage of cube orientation obtained by dividing the cube orientation area percentage by the total of the cube orientation area percentage, the brass orientation area percentage, the S orientation area percentage, and the copper orientation area percentage.

The KAM value was defined as $(\Sigma y)/n$, in which n represents the number of grains; and y represents the difference between measured crystal orientations.

Tensile Test:

JIS No. 13 B specimens were prepared from each sample so that the specimen's longitudinal direction be the rolling direction. The specimens were subjected to a tensile test using Instron Universal Testing System Model 5882 at a testing speed of 10.0 mm/min, and a gauge length (GL) of 50 mm to measure a 0.2% yield strength (MPa). In the tensile test, three specimens per each sample were tested, and the average of measured data was employed. A sample having a 0.2% yield strength (YP) in the transverse direction (TD) of greater than 650 MPa as measured in the tensile test was evaluated as having a high strength. The difference in tensile strength between the longitudinal direction (LD) and the transverse direction (TD) preferably falls within ±40 MPa. The difference in yield strength between the longitudinal direction (LD) and the transverse direction (TD) preferably falls within ±50 MPa.

Electrical Conductivity:

Strip specimens having a width of 10 mm and a length of 300 mm were prepared from each sample by milling so that the specimen's longitudinal direction be the rolling direction. The specimens were subjected to electrical conductivity measurement using double-bridge resistance measurement equipment, and the electrical conductivity was calculated by the average cross-sectional area method. Also in this measurement, three specimens per each sample were measured, and the average of measured data was employed. A sample having an electrical conductivity of 30% IACS or more as measured in the measurement was evaluated as having high electroconductivity.

Bending Workability:

A bend test of each copper alloy sheet sample was performed in a manner as follows. The sample sheet was cut to a specimen having a width of 10 mm and a length of 30 mm, and the specimen was subjected to 90-degree bending under a load of 1000 kgf (about 9800 N) at a bending radius of 0.15 mm as good way bend (with the bending axis being perpendicular to the rolling direction). Thereafter the specimen was subjected to U-bending under a load of 1000 kgf (about 9800 N), and the presence or absence of cracking in the bent portion was visually observed with an optical microscope at 50-fold magnification. The cracking herein was evaluated as ratings A to E prescribed in Japan Copper and Brass Association Technical Standard JBMA-T307. A sample evaluated as any of ratings A to C was evaluated as having superior bending workability.

Table 1 demonstrates that Examples 1 to 15 according to the present invention had suitable chemical compositions and were manufactured under suitable conditions both within the specific ranges or preferred ranges as described in the present invention. Table 3 demonstrates that these samples each had an average grain size, average area percentages of respective textures, and a KAM value controlled within the prescribed ranges, respectively. As a result, these samples not only achieved a high strength in terms of 0.2% yield strength (YP) in the transverse direction (TD) of greater than 650 MPa and a high electrical conductivity of 30% IACS or more, but also exhibited excellent bending workability. These samples also had smaller differences in tensile strength and in yield strength between the longitudinal direction (LD) and the transverse direction (TD).

Among them, Examples 2, 3, and 12 each had a relatively low cube orientation average area percentage and were evaluated on bending workability as relatively low of rating C. Example 5 had a relatively larger Sn content and thereby had a relatively lower electrical conductivity than those in other Examples.

In contrast, Comparative Examples 16 and 18 had an excessively high Ni or Si content higher than the upper limit of the range specified in the present invention, although they were manufactured under appropriate conditions. These samples therefore had a tensile strength and a 0.2% yield strength at excessively high levels and exhibited significantly poor bending workability as evaluated as rating D. Comparative Examples 20 and 21 had an excessively high Zn or Sn content higher than the upper limit of the range specified in the present invention, although they were manufactured under appropriate conditions. These samples therefore failed to control the cube orientation area percentage within the preferred range, had a tensile strength and a 0.2% yield strength at excessively high levels, and exhibited significantly poor bending workability as evaluated as rating D. On the contrary, Comparative Examples 17 and 19 had an excessively low Ni or Si content lower than the lower limit of the range specified in the present invention. These samples therefore had a low 0.2% yield strength (YP) in the transverse direction (TD) of 650 MPa or less.

Comparative Examples 22 to 33 had chemical compositions within the range specified in the present invention, but were manufactured under conditions, such as solution treatment condition, out of the preferred ranges as specified in the present invention. These samples therefore failed to have desired microstructures and were inferior in one or more properties such as strength, electrical conductivity, and bending workability to Examples.

Comparative Example 22 underwent a cold rolling to an excessively low working ratio (rolling reduction) before the final solution treatment. These samples had an excessively low final cube orientation area percentage and thereby exhibited poor U-bending workability (U-bendability).

Comparative Example 23 underwent a final solution treatment performed at an excessively low temperature. This sample had an excessively low final cube orientation area percentage and exhibited poor U-bending workability.

Comparative Example 24 underwent a final solution treatment performed at an excessively high temperature. This sample therefore had a large (average) grain size and exhibited poor U-bending workability.

Comparative Examples 25 and 26 underwent a final solution treatment performed at an excessively high rate of temperature rise. These samples therefore had a low cube orientation area percentage and exhibited poor U-bending workability.

Comparative Example 27 underwent a cold rolling to an excessively low cold rolling reduction after the final solution treatment. This sample therefore had an excessively low KAM value, exhibited high strength anisotropy, and had a low 0.2% yield strength (YP) in the transverse direction (TD) of 650 MPa or less.

Comparative Example 28 underwent a cold rolling to an excessively high cold rolling reduction after the final solution treatment. This sample therefore had an excessively high KAM value and an excessively low cube orientation area percentage and exhibited poor U-bending workability.

Comparative Examples 29 and 30 underwent steps after the solution heat treatment (solution treatment) in another order than the other samples (Examples and other Comparative Examples) as indicated in Table 2. Specifically, these samples underwent rolling (cold rolling) and aging in this order after the solution heat treatment. The samples therefore exhibited high strength anisotropy and had a low 0.2% yield strength (YP) in the transverse direction (TD) of 650 MPa or less. Among the comparative examples, Comparative Examples 29 and 30 exhibited high strength anisotropy due to excessively low KAM values. The order of the steps performed after the solution heat treatment in Comparative Examples 29 and 30 is as in Examples described in JP-A No. 2011-52316.

TABLE 1

| | | Chemical composition (in mass percent) | | | | | Rolling reduction (%) before solution | Solution heat treatment | | Aging | Cold rolling |
|---|---|---|---|---|---|---|---|---|---|---|---|
| Sample number | | Ni | Si | Zn | Sn | Fe, Mg, Co, Cr, Zr | treatment | ° C. | ° C./s | ° C. | % |
| Example | 1 | 3.2 | 0.7 | 1.0 | 0.20 | — | 95 | 840 | 0.03 | 460 | 40 |
| | 2 | 3.2 | 0.7 | 1.0 | 0.20 | — | 95 | 860 | 0.03 | 460 | 55 |
| | 3 | 3.2 | 0.7 | 1.0 | 0.20 | — | 90 | 840 | 0.03 | 460 | 40 |
| | 4 | 2.5 | 0.5 | 1.0 | 0.50 | — | 93 | 820 | 0.03 | 460 | 40 |
| | 5 | 1.0 | 0.2 | 0.5 | 1.80 | — | 95 | 800 | 0.03 | 400 | 40 |
| | 6 | 3.6 | 1.0 | 0.5 | 0.20 | — | 95 | 860 | 0.01 | 460 | 40 |
| | 7 | 3.6 | 1.0 | 0.5 | 0.20 | — | 95 | 860 | 0.03 | 460 | 25 |
| | 8 | 3.5 | 0.7 | 1.0 | 0.05 | — | 95 | 860 | 0.03 | 520 | 40 |
| | 9 | 3.5 | 0.7 | 1.0 | 0.05 | — | 95 | 860 | 0.03 | 400 | 40 |
| | 10 | 2.0 | 0.5 | 2.5 | 0.20 | Fe: 0.2 | 95 | 820 | 0.03 | 460 | 40 |
| | 11 | 3.2 | 0.7 | 0.1 | 1.00 | Cr: 0.3 | 95 | 840 | 0.03 | 460 | 40 |
| | 12 | 2.2 | 0.5 | 1.0 | 0.20 | Mg: 0.1 | 95 | 820 | 0.03 | 460 | 55 |
| | 13 | 2.0 | 0.5 | 1.0 | 0.20 | Ti: 0.2 | 95 | 860 | 0.03 | 460 | 40 |
| | 14 | 2.0 | 0.5 | 1.0 | 0.20 | Mn: 0.2 | 95 | 840 | 0.03 | 460 | 40 |
| | 15 | 1.5 | 0.6 | 1.0 | 0.20 | Co: 1.0, Zr: 0.20 | 95 | 860 | 0.03 | 460 | 40 |
| Comparative | 16 | 4.0 | 1.0 | 1.0 | 0.20 | — | 95 | 880 | 0.03 | 460 | 40 |
| Example | 17 | 0.8 | 0.2 | 1.0 | 0.20 | — | 95 | 800 | 0.03 | 460 | 40 |
| | 18 | 3.5 | 1.2 | 1.0 | 0.20 | — | 95 | 860 | 0.03 | 460 | 40 |
| | 19 | 1.0 | 0.1 | 1.0 | 1.10 | — | 95 | 820 | 0.03 | 460 | 40 |
| | 20 | 2.0 | 0.5 | 3.5 | 0.20 | — | 95 | 820 | 0.03 | 460 | 40 |
| | 21 | 1.2 | 0.3 | 1.0 | 3.50 | — | 95 | 820 | 0.03 | 460 | 40 |
| | 22 | 3.2 | 0.7 | 1.0 | 0.20 | — | 80 | 840 | 0.03 | 460 | 40 |
| | 23 | 3.2 | 0.7 | 1.0 | 0.20 | — | 95 | 780 | 0.03 | 460 | 40 |
| | 24 | 3.2 | 0.7 | 1.0 | 0.20 | — | 95 | 920 | 0.03 | 460 | 40 |
| | 25 | 3.2 | 0.7 | 1.0 | 0.20 | — | 95 | 820 | 50 | 460 | 40 |
| | 26 | 3.2 | 0.7 | 1.0 | 0.20 | — | 95 | 840 | 10 | 460 | 40 |
| | 27 | 3.2 | 0.7 | 1.0 | 0.20 | — | 95 | 840 | 0.03 | 460 | 20 |
| | 28 | 3.2 | 0.7 | 1.0 | 0.20 | — | 95 | 840 | 0.03 | 460 | 70 |

TABLE 2

| Sample number | | Chemical composition (in mass percent) Ni | Si | Zn | Sn | Fe, Mg, Co, Cr, Zr | Rolling reduction (%) before solution treatment | Solution heat treatment ° C. | ° C./s | Cold rolling % | Aging ° C. |
|---|---|---|---|---|---|---|---|---|---|---|---|
| Comparative Example | 29 | 3.2 | 0.7 | 1.0 | 0.20 | — | 95 | 820 | 0.03 | 20 | 460 |
| | 30 | 3.2 | 0.7 | 1.0 | 0.20 | — | 95 | 820 | 50 | 20 | 460 |

TABLE 3

| Sample number | | Grain size μm | Oriented grain area percentage (%) Cube | Brass + S + Copper | Brass | S | Copper | Goss | Cube percentage | KAM value |
|---|---|---|---|---|---|---|---|---|---|---|
| Example | 1 | 11 | 38 | 36 | 10 | 20 | 6 | 1 | 51 | 2.28 |
| | 2 | 16 | 28 | 41 | 13 | 22 | 6 | 1 | 41 | 2.48 |
| | 3 | 13 | 27 | 35 | 8 | 21 | 6 | 2 | 44 | 2.31 |
| | 4 | 11 | 36 | 35 | 9 | 20 | 6 | 3 | 51 | 2.24 |
| | 5 | 9 | 28 | 36 | 8 | 22 | 6 | 1 | 44 | 2.31 |
| | 6 | 12 | 36 | 35 | 8 | 20 | 7 | 3 | 51 | 2.22 |
| | 7 | 21 | 44 | 30 | 7 | 18 | 5 | 1 | 59 | 1.84 |
| | 8 | 13 | 37 | 37 | 10 | 20 | 7 | 2 | 50 | 2.10 |
| | 9 | 13 | 37 | 34 | 11 | 18 | 5 | 1 | 52 | 2.31 |
| | 10 | 12 | 32 | 39 | 12 | 21 | 6 | 2 | 45 | 2.26 |
| | 11 | 10 | 31 | 38 | 10 | 22 | 6 | 1 | 45 | 2.27 |
| | 12 | 11 | 25 | 42 | 8 | 25 | 9 | 3 | 37 | 2.46 |
| | 13 | 13 | 28 | 39 | 10 | 23 | 6 | 1 | 42 | 2.29 |
| | 14 | 15 | 33 | 37 | 9 | 21 | 7 | 2 | 47 | 2.25 |
| | 15 | 11 | 27 | 39 | 11 | 22 | 6 | 2 | 41 | 2.23 |
| Comparative Example | 16 | 9 | 22 | 45 | 12 | 24 | 9 | 2 | 33 | 2.34 |
| | 17 | 11 | 36 | 33 | 7 | 21 | 5 | 1 | 52 | 2.23 |
| | 18 | 9 | 21 | 44 | 13 | 23 | 8 | 1 | 32 | 2.26 |
| | 19 | 16 | 34 | 27 | 6 | 17 | 4 | 4 | 56 | 2.31 |
| | 20 | 8 | 16 | 51 | 18 | 26 | 7 | 3 | 24 | 2.26 |
| | 21 | 9 | 13 | 53 | 16 | 29 | 8 | 2 | 20 | 2.21 |
| | 22 | 11 | 7 | 49 | 11 | 28 | 10 | 1 | 13 | 2.27 |
| | 23 | 5 | 18 | 48 | 12 | 27 | 9 | 1 | 27 | 2.11 |
| | 24 | 33 | 46 | 28 | 6 | 16 | 6 | 1 | 62 | 2.41 |
| | 25 | 7 | 16 | 45 | 10 | 28 | 7 | 2 | 26 | 2.18 |
| | 26 | 10 | 18 | 43 | 9 | 28 | 6 | 2 | 30 | 2.26 |
| | 27 | 13 | 48 | 24 | 5 | 15 | 4 | 2 | 67 | 0.92 |
| | 28 | 13 | 7 | 61 | 18 | 31 | 12 | 1 | 10 | 3.01 |
| | 29 | 9 | 48 | 32 | 8 | 18 | 6 | 1 | 60 | 0.78 |
| | 30 | 7 | 38 | 35 | 9 | 21 | 5 | 1 | 52 | 0.77 |

TABLE 4

| Sample number | | Properties of final sheet: Tensile strength (TS) (MPa) L.D. | T.D. | L.D. − T.D. | Yield strength (YP) (MPa) L.D. | T.D. | L.D. − T.D. | T.S. − Y.P L.D. | T.D. | Electrical conductivity % IACS | U-bending workability G.W. | B.W. |
|---|---|---|---|---|---|---|---|---|---|---|---|---|
| Example | 1 | 772 | 766 | 6 | 741 | 728 | 13 | 31 | 38 | 42 | B | B |
| | 2 | 823 | 824 | −1 | 792 | 788 | 4 | 31 | 36 | 40 | C | C |
| | 3 | 768 | 754 | 14 | 733 | 716 | 17 | 35 | 38 | 41 | C | C |
| | 4 | 753 | 738 | 15 | 729 | 715 | 14 | 24 | 23 | 38 | B | B |
| | 5 | 734 | 705 | 29 | 696 | 667 | 29 | 38 | 38 | 31 | B | B |
| | 6 | 749 | 738 | 11 | 725 | 712 | 13 | 24 | 26 | 39 | B | B |
| | 7 | 757 | 733 | 24 | 724 | 691 | 33 | 33 | 42 | 41 | B | B |
| | 8 | 743 | 731 | 12 | 719 | 700 | 19 | 24 | 31 | 43 | B | B |
| | 9 | 735 | 725 | 10 | 714 | 703 | 11 | 21 | 22 | 38 | B | B |
| | 10 | 754 | 742 | 12 | 733 | 715 | 18 | 21 | 27 | 40 | B | C |
| | 11 | 744 | 727 | 17 | 720 | 711 | 9 | 24 | 16 | 42 | B | B |
| | 12 | 792 | 784 | 8 | 775 | 765 | 10 | 17 | 19 | 42 | C | C |
| | 13 | 787 | 764 | 23 | 756 | 736 | 20 | 31 | 28 | 32 | C | C |
| | 14 | 744 | 721 | 23 | 718 | 700 | 18 | 26 | 21 | 41 | B | B |
| | 15 | 760 | 741 | 19 | 726 | 709 | 17 | 34 | 32 | 40 | B | B |

TABLE 4-continued

| | | Properties of final sheet | | | | | | | | | | |
|---|---|---|---|---|---|---|---|---|---|---|---|---|
| | | Tensile strength (TS) (MPa) | | | Yield strength (YP) (MPa) | | | T.S. − Y.P | | Electrical conductivity | U-bending workability | |
| Sample number | | L.D. | T.D. | L.D. − T.D. | L.D. | T.D. | L.D. − T.D. | L.D. | T.D. | % IACS | G.W. | B.W. |
| Comparative Example | 16 | 841 | 833 | 8 | 821 | 792 | 29 | 20 | 41 | 37 | D | D |
| | 17 | 521 | 509 | 12 | 492 | 472 | 20 | 29 | 37 | 49 | A | A |
| | 18 | 824 | 809 | 15 | 776 | 757 | 19 | 48 | 52 | 38 | D | D |
| | 19 | 660 | 638 | 22 | 633 | 618 | 15 | 27 | 20 | 33 | A | A |
| | 20 | 729 | 709 | 20 | 682 | 643 | 39 | 47 | 66 | 38 | D | D |
| | 21 | 740 | 711 | 29 | 701 | 659 | 42 | 39 | 52 | 19 | D | D |
| | 22 | 766 | 718 | 48 | 722 | 670 | 52 | 44 | 48 | 40 | D | D |
| | 23 | 702 | 677 | 25 | 669 | 645 | 24 | 33 | 32 | 39 | D | D |
| | 24 | 792 | 777 | 15 | 766 | 749 | 17 | 26 | 28 | 41 | D | D |
| | 25 | 803 | 773 | 30 | 766 | 725 | 41 | 37 | 48 | 41 | D | D |
| | 26 | 781 | 755 | 26 | 751 | 719 | 32 | 30 | 36 | 42 | D | D |
| | 27 | 724 | 676 | 48 | 688 | 649 | 39 | 36 | 27 | 41 | B | B |
| | 28 | 837 | 832 | 5 | 825 | 821 | 4 | 12 | 11 | 40 | E | E |
| | 29 | 753 | 671 | 82 | 663 | 615 | 48 | 90 | 56 | 40 | A | A |
| | 30 | 766 | 697 | 69 | 682 | 624 | 58 | 84 | 73 | 41 | A | A |

While the present invention has been described in detail with reference to embodiments thereof with a certain degree of particularity, it will be understood by those skilled in the art that various changes and modifications are possible without departing from the spirit and scope of the invention.

INDUSTRIAL APPLICABILITY

The copper alloy according to the present invention has low strength anisotropy and excellent bending workability and is advantageously usable for electric and electronic components to be used typically in automobile connectors.

The invention claimed is:

1. A copper alloy, comprising:

by mass,

Ni in a content of from 1.0% to 3.6%;

Si in a content of from 0.2% to 1.0%;

Sn in a content of from 0.05% to 3.0%;

Zn in a content of from 0.05% to 3.0%; and copper, wherein:

the copper alloy has an average grain size of 25 μm or less;

the copper alloy comprises a texture having an average area percentage of cube orientation {001}<100> of from 20% to 60% and having an average total area percentage of specific three orientations of from 20% to 50% as measured by scanning electron microscope-electron back-scattering pattern analysis (SEM-EBSP) with the three orientations being brass orientation {011}<211>, S orientation {123}<634>, and copper orientation {112}<111>; and the copper alloy has a kernel average misorientation (KAM) value of from 1.00 to 3.00.

2. The copper alloy of claim 1, further comprising at least one element selected from the group consisting of Fe, Mn, Mg, Co, Ti, Cr, and Zr in a total content of from 0.01% to 3.0% by mass.

3. The copper alloy of claim 1, wherein the copper alloy has an average total area percentage of the three orientations of from greater than 40% to 50%.

4. The copper alloy of claim 2, wherein the copper alloy has an average total area percentage of the three orientations of from greater than 40% to 50%.

5. The copper alloy of claim 1, wherein the copper alloy has an average grain size of 15 μm or less.

6. The copper alloy of claim 1, wherein the copper alloy has an average area percentage of cube orientation {001}<100> of from 30% to 50%.

7. The copper alloy of claim 1, wherein the copper alloy comprises Zn in a content of from 0.05% to 1.5% by mass.

8. The copper alloy of claim 1, wherein the copper alloy comprises Sn in a content of from 0.1% to 1.0% by mass.

* * * * *